United States Patent [19]

Streubel et al.

[11] 4,197,904

[45] Apr. 15, 1980

[54] SUPPORT GUIDE ARRANGEMENT FOR A CONTINUOUS CASTING INSTALLATION

[75] Inventors: Hans Streubel, Düsseldorf, Fed. Rep. of Germany; Heinrich Marti, Forch, Switzerland

[73] Assignees: Schloemann-Diemag AG, Düsseldorf, Fed. Rep. of Germany; Concast AG, Zurich, Switzerland

[21] Appl. No.: 937,793

[22] Filed: Aug. 29, 1978

[30] Foreign Application Priority Data

Sep. 7, 1977 [DE] Fed. Rep. of Germany ..... 2740221

[51] Int. Cl.[2] ..... B22D 11/12

[52] U.S. Cl. ..... 164/448

[58] Field of Search ..... 164/448, 442

[56] References Cited

U.S. PATENT DOCUMENTS

| | | | |
|---|---|---|---|
| 3,524,495 | 8/1970 | Niskovskikh et al. | 164/448 |
| 3,707,184 | 12/1972 | Burkhardt et al. | 164/448 |
| 3,752,219 | 8/1973 | Burkhardt et al. | 164/448 |
| 3,867,827 | 2/1975 | Backhaus et al. | 164/448 |
| 3,891,025 | 6/1975 | Bollig et al. | 164/448 X |
| 3,963,069 | 6/1976 | Marti et al. | 164/448 |
| 4,058,154 | 11/1977 | Streubel et al. | 164/448 X |
| 4,071,074 | 1/1978 | Bollig et al. | 164/448 |
| 4,131,154 | 12/1978 | Vial et al. | 164/448 |

*Primary Examiner*—Robert D. Baldwin
*Assistant Examiner*—J. Reed Batten, Jr.
*Attorney, Agent, or Firm*—Werner W. Kleeman

[57] ABSTRACT

A support guide arrangement or roller apron framework for a continuous casting installation having guide rolls and drive rolls, the rolls associated with each strand path of travel are mounted in sections at traverses or cross members and the oppositely situated traverses are adjustable by spindles as to their mutual spacing along a guide and movable away from one another, against the action of resilient load limiting means, in the presence of overloads. At least one of the oppositely situated traverses is pivotably guided at yokes which are adjustable by the spindles along the guide about axes extending essentially parallel to the rolls. At the yokes there are mounted stops which limit the positional advancement of the traverse towards a reference strand path of travel and the resilient load limiters are effectively arranged between the yokes and the traverse.

6 Claims, 4 Drawing Figures

Fig. 3
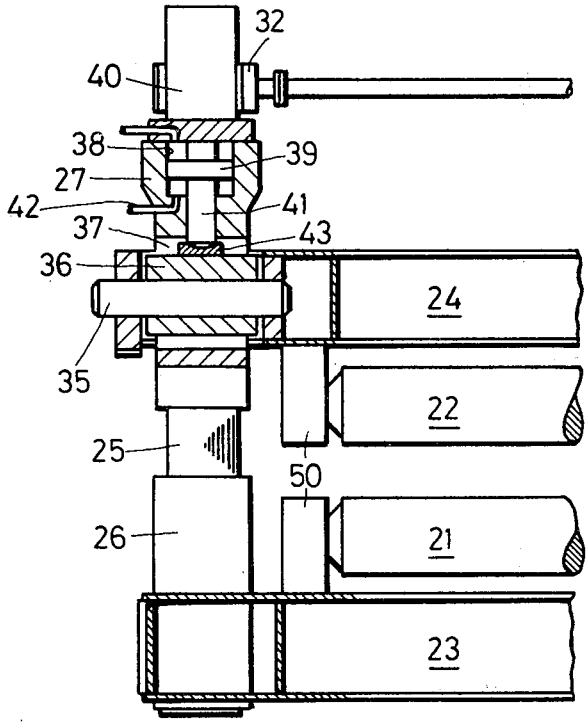
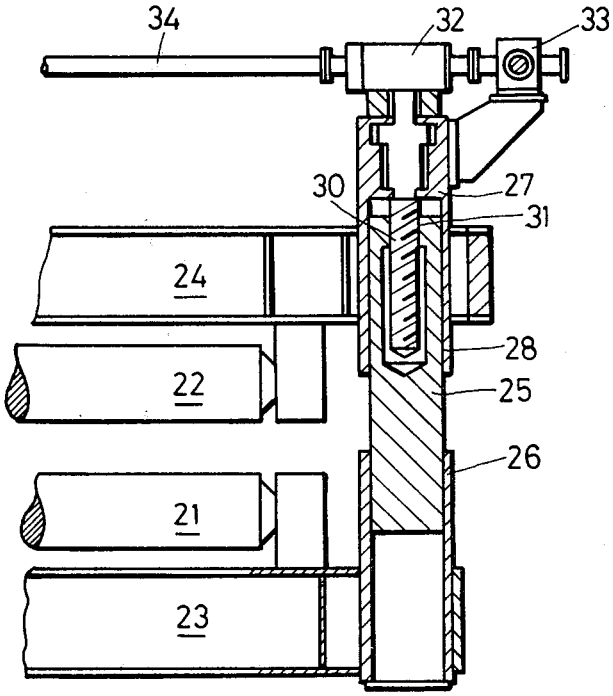
Fig. 4

SUPPORT GUIDE ARRANGEMENT FOR A CONTINUOUS CASTING INSTALLATION

BACKGROUND OF THE INVENTION

The present invention relates to a new and improved construction of a support guide arrangement, also referred to in the art as a roller apron framework, for a continuous casting installation and of the type having guide rolls and drive rolls, wherein the rolls associated with each strand path of travel are mounted in sections at traverses and the oppositely situated traverses are adjustable along a guide or guide arrangement by spindles as concerns their mutual spacing from one another and can be moved away from one another against resilient load limiters in the presence of overload.

The continuous casting art is already acquainted with arrangements employing support guides having rolls mounted at traverses or cross members. The traverses which are guided upon columns can be positionally adjusted by spindles in relation to stationary traverses. This mechanical adjustment device affords, in relation to the equally known adjustment by hydraulic cylinders against exchangeable stops, the advantage of infinite adjustability and independence from a hydraulic system.

Also belonging to part of the state of the art is particularly a roller apron or strand guide arrangement wherein two guide columns for an upper traverse are anchored at a stationary traverse. Arranged at the lower traverse are four bolts onto whose upper threaded portion there are screwed or threaded nuts mounted at the upper traverse and provided with a worm drive for adjusting the strand cross-sectional shape or format. The bolts are movably mounted at the lower traverse against overload by means of a package or set of plate springs. Measuring cells are arranged between the threaded part and the attachment part of the bolts.

This prior art roller apron has the drawback that irregular thermal expansions and non-symmetrical overload situations cause binding at the guides, bending of the bolts as well as leading to pronounced overload of individual rolls, since in this construction there is not provided any possibility for deviation of the traverse. A further drawback is that the worm drive of the adjustment nuts must be designed for overload situations, in order to be able to open the roller apron under load in the presence of disturbances.

SUMMARY OF THE INVENTION

Hence, with the foregoing in mind it is a primary object of the present invention to provide a new and improved construction of support guide arrangement for a continuous casting installation which is not associated with the aforementioned drawbacks and limitations of the prior art constructions.

A further significant object of the present invention aims at providing a support guide arrangement or roller apron which is adjustable by spindles and has an overload safety, in order to thereby prevent binding at the guides, bending of the spindles and too pronounced loading of individual rolls also in the event of irregular thermal expansion and non-symmetrical overload phenomena.

Yet a further significant object of the present invention is to provide a new and improved construction of a roller apron framework which is relatively simple in construction and design, economical to manufacture, extremely reliable in operation, not readily subject to breakdown or malfunction, and particularly avoiding or at the very least minimizing the disadvantages present with the prior art support guide arrangements employed in continuous casting installations as discussed above.

Now, in order to implement these and still further objects of the invention, which will become more readily apparent as the description proceeds, the support guide arrangement of the present development is manifested by the features that at least one of the oppositely situated traverses is pivotably guided at both ends externally of the roll bearings about axes extending essentially parallel to the rolls at yokes which are adjustable by means of the spindles along the guide or guide arrangement. Further, stops mounted at the yokes limit the application or positional advance of the traverse with regard to a reference strand path of travel and there are effectively arranged resilient load limiters between the yokes and the traverse.

By virtue of the foregoing structure there are obtained the following advantages: Notwithstanding the infinite mechanical application of the traverse by means of the spindles the traverse, in the presence of strand irregularities over the cross-section thereof, can be raised at one side within the guide in the yoke against the spring force of the load limiter. In the case of a non-uniform or irregular strand in its lengthwise direction the traverse can carry out an appropriate pivotal or rocking motion, so that in the presence of overload situations loading of individual rolls can be reduced by virtue of the traverse bearing against the stops arranged at the opposite side. Finally, there is realized a simple possibility of relieving the spindles against overload forces.

According to a further feature of the invention the effect of the force of the load limiter can be annihilated by force devices which act in opposition to the load limiters. In this way there is possible relief of the spindles in the event of a disturbance, so that the spindle drive need only be designed to overcome the inherent weight of the yokes and traverse with the rolls.

There can be advantageously employed as the load limiter pre-biased or pre-stressed elastomeric springs. In relation to conventional sets or packages of plate springs such afford the advantages of, for instance, flatter spring characteristic, lower installation dimensions and reduced friction.

A further construction of the invention contemplates that one traverse contains at each side a slide block connected by means of bolts or equivalent structure, the slide block being displaceable in a guide located at the yokes. The load limiter housed at the yoke is effective upon the slide block by means of a ball socket.

The action of the force of the load limiter between the traverse and the yokes can be annihilated or diminished in a very simple manner in that the force devices are arranged in the yokes as pressurized cylinders whose pistons arranged between the load limiter and the slide block can be impinged or loaded in the sense of a compression of the load limiter.

Each yoke can be advantageously guided upon two columns or posts or equivalent structure. This affords an extremely compact construction inasmuch as the spindles mounted in the yokes and equipped with a rotary drive can be threaded into the threads arranged in the columns. This expedient also enables the realization of a high guiding accuracy for the spindles.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 3 is a cross-sectional view of the arrangement of FIG. 2, taken substantially along the line III—III thereof; and FIG. 4 is a cross-sectional view of the arrangement of FIG. 2, taken substantially along the line IV—IV thereof.

DETAILED DESCRIPTION OF THE INVENTION

Figure 1:
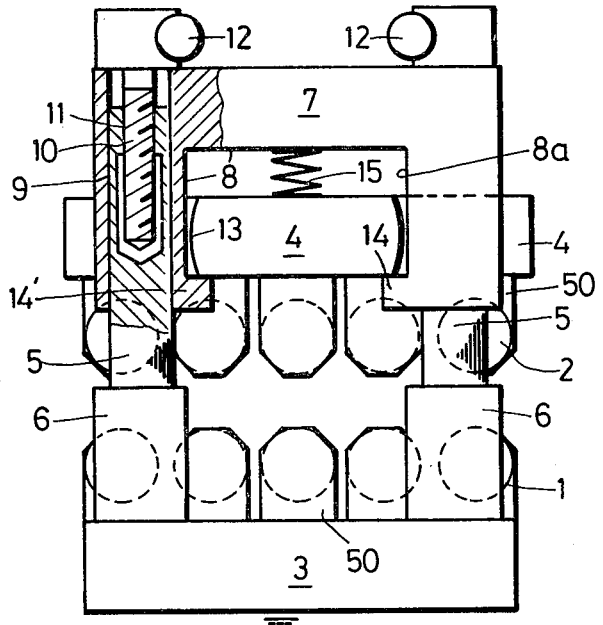
FIG. 1 is a sectional view of a support guide arrangement or roller apron framework having a traverse guided directly at yokes and constructed according to the teachings of the present invention.

Describing now the drawings, it is to be understood that only enough of the continuous casting installation or plant has been illustrated in the drawings in order to enable those skilled in the art to readily understand the underlying principles and concepts of the present invention. Thus, by referring to FIG. 1 it will be understood that there is illustrated therein a section of a roller apron framework or support guide arrangement wherein the rolls 1 and 2, mounted in roll bearings 50, form the paths of travel of a strand which has not been particularly shown. These rolls or rollers 1 and 2 are mounted by means of their roll bearings or supports 50 at a stationary traverse or cross member 3 and an adjustable traverse or cross member 4. Guides in the form of two columns or posts 5 are anchored by means of sleeves 6 at each side of the stationary or fixed traverse or cross member 3.

At each side there is mounted at each of the two columns 5 a respective yoke 7 or equivalent structure. Each yoke 7 has guide openings 9, as particularly well recognized by referring to the left-hand cross-sectional portion of FIG. 1. Threaded spindles 10 are rotatably mounted in the yokes 7. These threaded spindles 10 are threaded into threads 11 arranged within the columns or posts 5. The spindles 10 are rotatable by worm drives or gearing 12 arranged upon the yokes 7. The yokes 7 are provided with an intermediate or central recess or cutout 8 at whose guide surfaces 8*a* there is guided the adjustable traverse 4 having short guide surfaces 13. The movement of the adjustable traverse 4 in relation to the yokes 7 is limited with regard to the reference strand path of travel by stops or impact members 14. Arranged between the yokes 7 and the adjustable traverse 4 are load limiters 15 for the resilient bracing or supporting of the adjustable traverse 4. This arrangement enables the adjustable traverse 4, in the case of overload, to carry out a deviation or positional shifting out of the position determined by the spindles 10.

In the event of irregularities in the surface of the cast strand or casting the adjustable traverse 4 can be raised, for instance from the stop 14 of the yokes 7 and rocked or pivoted about the stop 14'. The adjustable traverse 4 thus rocks or pivots about an axis extending essentially parallel to the rolls 1, 2 and which, as a general rule, lies at a contact edge of the traverse 4 at the stops or impact members 14. Due to this deviational movement there is avoided binding of the columns 5 in the guide openings 9 and there is reduced the loading of individual rolls 2.

Figure 2:
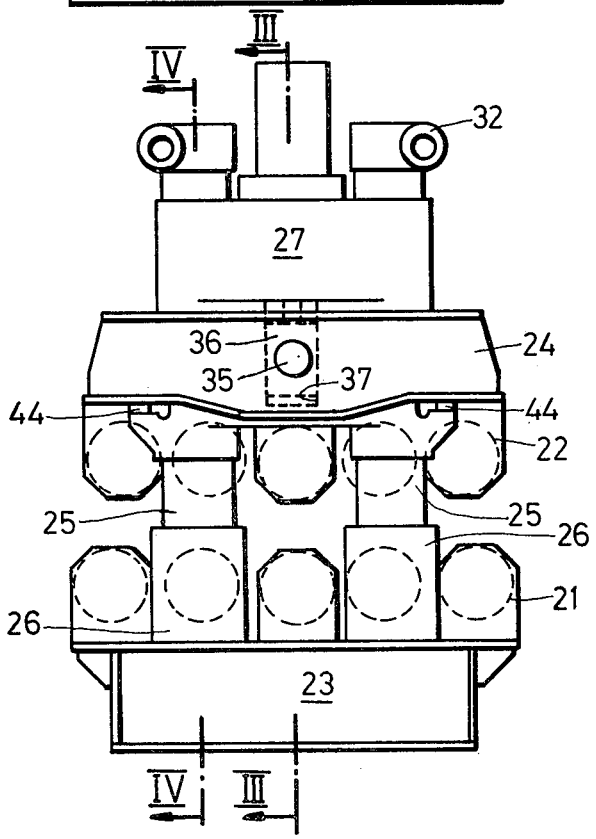
FIG. 2 is a sectional view of a support guide arrangement having a traverse guided by means of slide blocks at the yokes.

Also with the modified sectional illustration of the roller apron framework or support guide arrangement of FIGS. 2-4 the rolls 21 and 22 which form the guide paths of travel for the continuously cast strand or the like are mounted at a fixed or stationary traverse 23 and an adjustable traverse 24. In terms of the expression strand guide paths of travel as used herein what is meant is that, for instance, the upper rolls, such as the rolls 2 or 22 of the arrangements of FIGS. 1 and 2 form a guiding path of travel for the upper surface of the cast strand, whereas the other lower respective rolls 1 and 21 of the arrangements of FIGS. 1 and 2 form a guiding path of travel for the lower surface or underside of such continuously cast strand. The reference strand path of travel is that which has been set for a given strand section between these upper and lower coacting rolls.

Continuing, anchored at the fixed or stationary traverse 23 are the columns 25 by means of the sleeves 26 or equivalent structure. At each side a yoke 27 having guide openings 28 is mounted at two of the columns 25. Rotatably mounted in the yokes 27 are spindles 30 in a thrust bearing. These spindles 30 are threaded into central threading or threads 31 arranged within the columns 25. The spindles 30 are rotatable by worm drives or gearing 32, which are synchronized by bevel gearing 33 and connection shafts 34 in order to obtain synchronized operation.

The adjustable traverse or cross member 24 encloses at each side or end a yoke 27. At each side of the adjustable traverse 24 there are twice held bolts 35 in a position essentially parallel to the rolls 22. At each bolt 35 there is pivotably mounted a slide block 36 or equivalent structure which is displaceable perpendicular to the guide path in a guide 37 provided in the yokes 27. A cylinder 38 is provided in each yoke 27 in alignment with regard to the guide 37 of the slide block 36, this cylinder 38 having a piston 39 which bears against a pre-stressed elastomeric spring 40 in the yoke 27. The piston rod 41 of the piston 39 is in contact with the slide block 36 by means of a ball or base-plate socket 43. The adjustable traverse 24 is supported in the direction of the strand by lateral stops or impact members 44 at the yokes 27. With this arrangement the adjustable traverse 24 together with the slide blocks 36 can deviate against the force of the elastomeric spring 40. This can occur, in the event of irregularities transverse with respect to the direction of travel of the strand, also at one side by pivoting about the stops provided at the one yoke 27. In the event of irregularities extending over the length of the cast strand the adjustable traverse 24 can follow the irregularities of the strand by pivoting about stops or impact members 44 arranged at the infeed side or outfeed side at the yokes 27. Also in this case there are avoided binding at the columns 25 and bending of the spindles 30 and there is reduced loading of the individual rolls 22 acted upon by the strand irregularities, e.g., uneveness of the strand.

In the event of a disturbance the pistons 39 can be impinged with pressure by application of a pressurized fluid medium, such as a hydraulic liquid or grease which is fed in by means of a line or conduit 42. In this way there can be eliminated the force action of the load limiter constructed as an elastomeric spring 40. The slide or sliding blocks 36, adjustable traverse 24 as well as the rolls 22 are relieved of load. In this manner, in the event of disturbance, the spindles 30 can be relieved so that the spindle drives need only be designed for overcoming the inherent weight of the assembly composed of the yokes 27, the traverse 24 and the guide rolls 22.

While there are shown and described present preferred embodiments of the invention, it is to be distinctly understood that the invention is not limited thereto, but may be otherwise variously embodied and practiced within the scope of the following claims. Accordingly,

What we claim is:

1. A support guide arrangement for a continuous casting installation for strands comprising:

oppositely situated traverses arranged in spaced relationship from one another;

rolls mounted by roll bearings at each of the oppositely situated traverses;

guide means;

at least one of the oppositely situated traverses being provided with yokes adjustable along the guide means;

spindles cooperating with the yokes for adjustment of the yokes along the guide means;

means for pivotably guiding said at least one traverse at the yokes about an axis extending essentially parallel to the rolls of said at least one traverse;

said means for pivotably guiding including stop means mounted at said yokes for limiting the positional shifting of said at least one traverse with respect to a reference path of travel of the continuously cast strand;

resilient load limiter means enabling the oppositely situated traverses to be movable relative to one another away from one another in the event of an overload; and said resilient load limiter means being effectively arranged between the yokes and said at least one traverse.

2. The support guide arrangement as defined in claim 1, further including:

force applying means effective opposite to the load limiter means for eliminating the action of the force of the load limiter means.

3. The support guide arrangement as defined in claim 1, wherein:

said load limiter means comprises pre-stressed elastomeric springs.

4. The support guide arrangement as defined in claim 1, wherein:

said at least one traverse has opposed ends;

each end of said one traverse having a slide block connected by a bolt with said at least one traverse;

said slide block being displaceable in a guide which is located at the related yoke; and each load limiter means carried by its related yoke being effective by means of a ball socket at the related slide block.

5. The support guide arrangement as defined in claim 2, wherein:

each of the force applying means comprises pressurized piston and cylinder means arranged in the yokes;

the piston of each pressurized piston and cylinder means being arranged between the related load limiter means and the slide block and can be impinged with a pressurized fluid medium for the purpose of compressing the load limiter means.

6. The strand guide arrangement as defined in claim 1, wherein:

said guide means include a pair of columns for each yoke at which each such yoke is guided.

* * * * *